United States Patent [19]

Mueller

[11] 3,957,423

[45] May 18, 1976

[54] STRIPPER FINGER DESIGN

[75] Inventor: Karl J. Mueller, Fairport, N.Y.

[73] Assignee: Xerox Corporation, Stamford, Conn.

[22] Filed: Jan. 8, 1974

[21] Appl. No.: 431,641

[52] U.S. Cl. ..... 432/60; 432/228; 271/DIG. 2; 118/60; 118/70; 118/245; 101/425; 15/256.51

[51] Int. Cl.[2] ..... G03G 13/08; B05C 11/00

[58] Field of Search ..... 432/59–60, 432/227–228, 75, 2; 219/216, 388, 469; 271/DIG. 2, 80, 174; 118/60, 70, 245; 101/425; 100/93 RP, 173, 174; 15/236 A, 256.51; 355/15, 104, 110, 117

[56] References Cited

UNITED STATES PATENTS

| | | | |
|---|---|---|---|
| 1,675,363 | 7/1928 | Lodding | 15/256.51 |
| 1,737,616 | 12/1929 | Saatman | 118/245 |
| 1,800,443 | 4/1931 | Dustan et al. | 15/256.51 |
| 1,846,914 | 2/1932 | Sharp | 100/174 |
| 2,704,026 | 3/1955 | Rogge et al. | 101/425 |
| 2,732,773 | 1/1956 | Smith | 15/256.51 |
| 3,718,116 | 2/1973 | Thettu | 118/60 |
| 3,736,055 | 5/1973 | Davidge et al. | 118/637 |
| 3,844,252 | 10/1974 | Thettu | 432/60 |

*Primary Examiner*—John J. Camby
*Assistant Examiner*—Henry C. Yuen

[57] ABSTRACT

Contact fuser for a xerographic reproducing apparatus characterized by the provision of means for stripping the copy paper from the heated fuser roll. The stripping means is characterized by the provision of a plurality of finger-like elements which are pivotally mounted such that the pivot point is disposed intermediate the fuser roll and an area contacted by the copy whereby the weight of the copy on the finger-like elements serves to minimize adverse forces of the elements on the fuser roll.

5 Claims, 2 Drawing Figures

STRIPPER FINGER DESIGN

BACKGROUND OF THE INVENTION

This invention relates, in general, to apparatus for heat fusing toner images onto a copy paper in a xerographic reproducing apparatus and, more particularly, to stripping apparatus suitable for stripping copies from a fuser roll or similar fuser structure.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse an electroscopic toner material onto a support member by heat, it is necessary to elevate the temperature of the toner material to a point at which the constituents of the toner material coalesce and become tacky. This action causes the toner to be absorbed to some extent into the fibers of the support member which in many instances constitutes plain paper. Thereafter, as the toner material is cooled, solidification of the toner material occurs causing the toner material to be firmly bonded to the support member.

In both the electrographic as well as the xerographic recording arts, the use of thermal energy for fusing toner images onto a support member is old and well-known.

One approach to thermal fusing of electroscopic toner images onto a support has been to pass the support with the toner images thereon between a pair of opposed roller members at least one of which is either externally or internally heated.

During operation of a fusing system of the above-described type, the support member to which the toner images are electrostatically adhered is moved through the nip formed between the rolls with the toner image contacting the fuser roll to thereby produce heating of the toner images within the nip. By controlling the heat transferred to the toner and by the provision of proper roll surface materials virtually no offsetting of the toner particles from the copy sheet to the fuser roll is experienced under normal conditions. This is because the heat applied to the surface of the roller is insufficient to raise the temperature of the surface of the roller above the hot offset temperature of the toner whereat the toner particles in the image areas of the toner would liquify and cause a shearing action in the molten toner to thereby result in offset. Shearing occurs when the inter-particle or cohesive forces holding the viscous toner mass together is less than the surface energy or adhesive forces tending to offset it to a contacting surface such as the fuser roll.

Occasionally, however, extraneous toner particles will be offset to the fuser roll by an insufficient application of heat to the surface thereof; by imperfections in the properties of the entire surface of the roll, or by the toner particles insufficiently adhering to the copy sheet by the electrostatic forces which normally hold them there. In such a case, extraneous toner particles may be transferred to the surface of the fuser roll beyond the nip, with subsequent transfer to the back-up roll during periods of time when no copy paper is in the nip and before the back-up roll can be moved out of contact with the fuser roll.

It will be appreciated that in order to prevent such toner particles being transferred to the copy paper it is necessary to remove the toner particles from the fuser roll and/or the back-up roll. It will be further appreciated that if enough toner accumulates on the back-up roll the paper feed will be affected.

One arrangement for minimizing the foregoing phenomena, commonly referred to as "offsetting," has been to provide a fuser roll with an outer covering or sleeve of polytetrafluoroethlene, commonly known as Teflon, to which a release agent such as silicone oil is applied. Silicone based oils, which possess a relatively low surface energy, have been found to be a material that is suitable for use in the heated roll fuser environment. In practice, a thin layer of silicone oil is applied to the surface of the heated roll to thereby form an interface between the roll surface and the toner images carried on the support material. Thus, a low surface energy layer is presented to the toner as it passes through the fuser nip and thereby prevents toner from adhering to the fuser roll surface. Although the low surface energy oils generally act as a non-wetting fluid in regard to most support materials, it has been found that a mechanical flowing of the release agent from the roll onto the support material will occur if an excess of oil is allowed to accumulate in a region where it can come into contact with the copy paper. Accordingly, the amount of oil applied to the roll surface is generally metered under controlled conditions to maintain a relatively thin coating of the release agent on the roll surface.

As the copy sheet passes out of the nip formed by the fuser roll and the back-up roll, it is necessary to provide means such as stripper blades or finger-like members to insure that the copy paper proceeds along a predetermined path from the nip of the fuser roll and back-up roll to a conveyor belt or the like for moving the copy paper towards the exit of the machine or apparatus. Such stripper members usually contact the surface of the roll and it has been found that due to such contact the oil forming the release agent tends to accumulate at the point of contact near the leading edge of the stripper member. It has been found that such accumulation will cause excess amounts of oil to be picked up by the copy paper thus adversely affecting the quality of the copy produced.

Furthermore, excessive contact pressure between the stripper members and the fuser roll can produce excessive wear of one or both of the foregoing. Excessive forces are attributable to the weight of the copy paper when it contacts the stripper members.

It is therefore the primary object of the present invention to provide an improved roll fusing device for fixing toner images.

Another object of the present invention is to provide improved means for removing a copy sheet from the surface of a heated fusing roll.

Yet another object of the present invention is to provide a stripping device in conjunction with a heated fusing roll which minimizes the contact forces between stripper members and a fuser roll when the stripper members are contacted by the copy paper.

BRIEF SUMMARY OF THE INVENTION

The above-cited objects of the present invention are accomplished by means of a sheet removal device which is adapted to move between the surface of a fuser roll which may be coated with oil and an image bearing support member attached thereto. The sheet removal device is characterized by the provision of one or more stripper elements which are pivotally mounted such that the pivot point is disposed intermediate the fuser roll and an area of the stripper member contacted by the copy paper. The foregoing arrangement produces forces on the stripper members which instead of causing the stripper members to move into engagement with the fuser roll, the tendency is in the opposite direction.

For a better understanding of the present invention as well as other objects and further features thereof, reference may be had to the following detailed description of the invention to be read in conjunction with the accompanying drawings wherein:

FIG. 1 is a perspective view in partial section illustrating a heated pressure roll image fixing assembly employing the sheet removal apparatus of the present invention; and FIG. 2 is an end view partially in section, of the lower fuser roll of the assembly shown in FIG. 1 illustrating the sheet removal apparatus of the present invention positioned in an operative orientation.

DETAILED DESCRIPTION OF THE INVENTION

Figure 1:
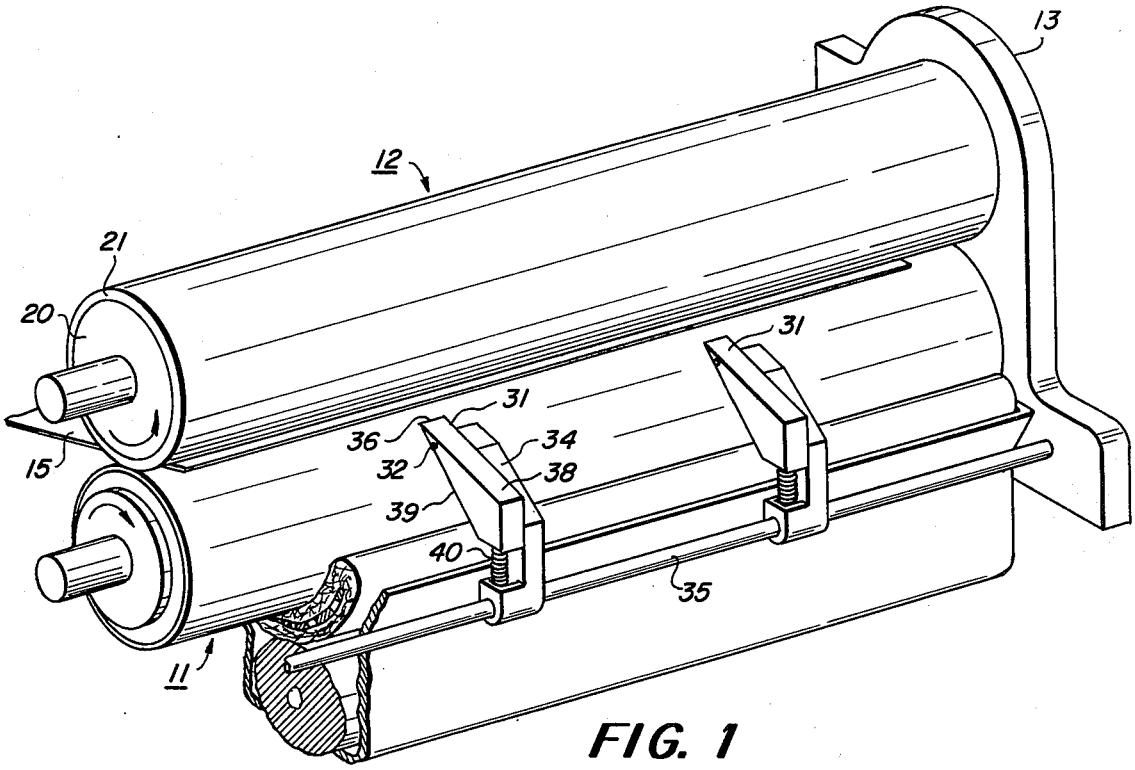

Referring now to FIG. 1, there is shown a typical heat pressure roll fusing system utilizing the sheet removal apparatus of the present invention. A pair of co-acting fuser rolls, including a lower heated roll 11 and an upper back-up roll 12, are rotatably mounted within a support frame 13 and have drive means (not shown) operatively associated therewith for rotating the rolls at synchronous speeds in the direction indicated by the arrows. One of the roll members, in this particular case the bottom roll 11, is provided with an internal source of heat energy and it is arranged so that its outer surface contacts the toner image bearing side of a copy sheet 15 as the sheet is transported through the nip of the fuser roll assembly. The lower or heated roll 11 is formed of a resilient blanket 16 which is supported by a rigid core 17 and has a thin layer of relatively abhesive material 18, for example, polytetrafluoroethylene, positioned thereover. Disposed axially through the interior of the rigid core 17 is a quartz heating lamp 19 which functions to transfer the proper amount of energy to the roll member so as to raise the surface temperature thereof to a predetermined operating level.

The upper or back-up fuser roll 12 is made of a relatively rigid cylindrical substrate 20, preferably steel or aluminum, over which is provided a relatively thick sleeve 21 of polytetrafluoroethylene. In operation, the two rolls 11 and 12 are mounted in the frame so that the upper resilient roll 12 is deformed against the more rigid lower heated roll 11 thus creating an extended nip therebetween through which the copy sheet is passed during the fusing process. During passage of the sheet, sufficient pressure and heat energy is transferred from the fuser assembly to the copy sheet to effect the desired toner coalescing and consequently image fixing. It will be appreciated that while the rolls 11 and 12 are disposed in a particular orientation relative to each other therefore the fuser roll 11 is subadjacent the back-up roll 12, the positions of the rolls can be interchanged without departing from the spirit and scope of the invention. It will further be appreciated that suitable means should be provided for maintaining the rolls 11 and 12 out of contact with each other during periods of non-operation. To this end, mechanism (not shown) can be provided which will move one or the other of the rolls from its normal operating position to a retracted position whereby the rolls are out of engagement.

Alternatively, one of the rolls 11 and 12 could be provided with a flat spot thereon extending the longitudinal axis thereof and the rolls could be so synchronized as to be brought to a rest position whereby the flat portion of the one roll is opposite the other roll.

In order to prevent the toner particles forming the image carried by the support sheet from being offset onto the heated roll surface of roll 11, as the sheet is drawn through the fuser nip, the heated roll is provided with a layer of oil constituting a release agent capable of preventing the toner particles from being offset to the heated roll surface. Silicone based oils have been found to be suitable release agents for this intended purpose.

Figure 2:
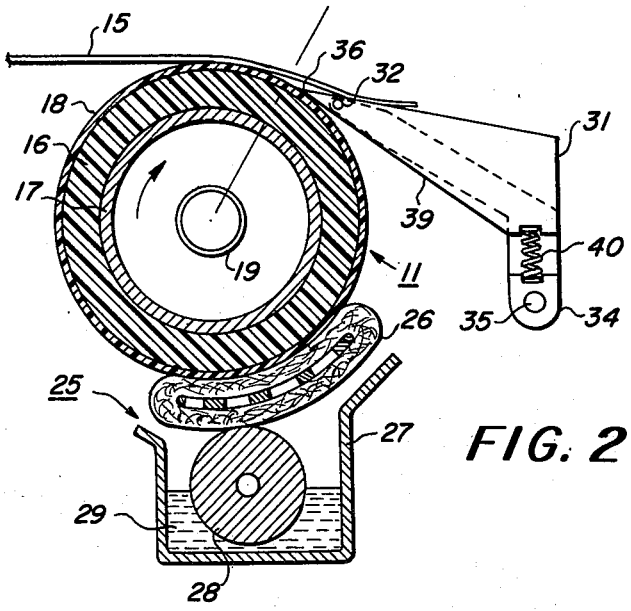

An oil applicating mechanism, generally referenced 25, is positioned adjacent to the lower portion of the heated fuser roll 11 as illustrated in FIGS. 1 and 2. An applicator wick 26 is mounted in the upper part of the housing 27 and is arranged to contact the lower portion of a heated roll surface. A rotating oil metering cylinder 28 is located directly beneath the wick and serves to transport a predetermined amount of oil from a housing sump region 29 upwardly into contact with the wick surface. Sufficient oil is carried to the wick by the metering roll to allow the wick to apply to the outer periphery of the fuser roll a relatively even layer of oil. The oil layer applied to the fuser roll surface must be thick enough to act as an interface between the roll surface and the copy sheet to prevent toner offsetting but yet must be thin enough to prevent wetting of the copy sheet as it comes through the fuser nip. For further information concerning this type of oil metering system reference may be had to U.S. Pat. No. 3,718,116.

As the image-bearing support sheet passes through the nip of the fuser roll assembly the sheet tends to follow the rotation of the heated fuser roll surface thereby necessitating the provision of some mechanism for effecting the removal of the support sheet from the fuser roll surface, after the image has been fixed thereto. To this end, one or more pickoff or stripper fingers 31 are mounted slightly after the nip of the fuser roll assembly and are arranged to be disposed between the fuser roll surface and the copy sheet moving through the nip. As the copy sheet leaves the fuser nip it initially comes into contact with the upper surface of the stripper fingers 31 at the leading edge thereof. The fingers thus are interposed between the sheet and the fuser roll to thereby redirect the sheet along a predetermined path of travel away from the roll thereby effecting the desired separation of the copy sheet from the fuser roller.

As illustrated in FIGS. 1 through 2 the sheet removal apparatus of the present invention comprises a pair of pickoff fingers 31 which are pivotally mounted upon the free ends of pivot pins 32. The pivot pins 32 are anchored at one end thereof in support members 34 which are, in turn, supported by an elongated member 35 secured to the support frame 13. Each finger is provided with a contacting edge 36 of relatively small thickness formed by a top surface 38 and a bottom surface 39. The fingers are supported in the fuser assembly such that the lower or bottom surface 39 rests on the fuser roll 11 and is retained in that position due to the bias effect of spring members 40 tending to rotate them in the counterclockwise direction as viewed in FIG. 2, about the pivot pins 32. It will be appreciated that the spring constant will vary in accordance with the surface material of the fuser roll and the specific configuration employed and the requirements dictated thereby. The spring members are stationarily mounted at one end to the elongated member 35 which serves as a positive stop to limit the movement of the fingers 31. In order to implement the inventive concept disclosed, the location of the pivot pins 32 is such that they are disposed intermediate the fuser roll 11 and an area 41 contacted by the copy paper 15. When the paper contacts the fingers in this location the weight of the paper tends to rotate the fingers in a clockwise direction, as viewed in FIG. 2, to thereby minimize the force of the fingers 31 on the fuser roll 11 which in turn, lessens the accumulation of oil at the leading edges 36 and also the wear of the fingers and the fuser roll.

To prevent toner from adhering to the surface of the pickoff fingers 31 as copy sheets are drawn thereover, and to also minimize wear thereof, the picker fingers are preferably constructed of a material that will neither mechanically nor chemically interact with the toner in a manner to cause the toner to adhere to the surfaces thereof. Such materials, as aromatic polyesters, as for example, Ebonol as manufactured by the Carborundum Company of Sanborn, N.Y., which are loaded with trifluoroethylene filler; amide imides, as for example, Amoco A1-11L4 as supplied by the Amoco Chemical Company of Seymour, Ind., which are loaded with a graphite or trifluoroethylene filler, poly imides, as for example, Vespel as manufactured by the Dupont Company, which are coated with a layer of trifluoroethylene have all been found to exhibit non-adhering or abhesive characteristics to toner and are well-suited for the use in such a construction.

While this invention has been described with reference to the structure disclosed herein, it is not necessarily confined to such details as set forth and this application is intended to cover such modifications or variations which may come within the scope of the following claims.

What is claimed is:

1. Apparatus for fusing toner images to a substrate by utilization of thermal energy, said apparatus comprising:

a pair of nip forming members;

means for elevating the temperature of one of said members sufficient to effect fusing of said toner images to said substrate upon being contacted by said one of said members;

means having contacting edge for stripping said substrate from said one of said members;

means for pivotally mounting said stripping means adjacent said one of said members such that said substrate contacts an upper surface of said stripping means, said means for pivotally mounting said stripping means being adjacent to said contacting edge and disposed intermediate said one of said members and the area of said stripper means normally contacted by said substrate whereby the force of contact between the stripping means and said one of said members is minimized; and means providing a bias force on said stripping means in a direction opposite to the force exerted by said substrate thereon to effect engagement of said stripping means and said one of said members when said substrate is out of contact with said one of said members.

2. Apparatus according to claim 1 including stop means for limiting the effect of the contact of said stripping means by said substrate.

3. Apparatus for contact fusing of toner images to copy paper, said apparatus comprising:

a heated roll structure;

a backup roll structure forming a nip with said heated roll structure through which the copy paper passes with said toner images contacting said heated roll structure;

means contacting said heated roll structure for stripping of said copy paper from said heated roll structure and causing said copy paper to move thereacross; and means for lessening the contact forces between said stripper means and said heated roll structure as said copy paper normally contacts said stripping means.

4. Apparatus according to claim 3 wherein said contact force lessening means comprises means for pivotally mounting said stripper means at one end thereof whereby the pivot point of said stripping means is disposed adjacent said heated roll structure, said stripping means being contacted by said copy paper at an area remote from said heated roll structure; and means for biasing the end of said stripper means remote from said pivot point thereby effecting contact between said stripping means and said heated roll structure when the former is not contacted by said copy paper.

5. Apparatus according to claim 4 including means for limiting the effect of said biasing means on said stripping means.

* * * * *